US006634320B2

(12) United States Patent
Grando et al.

(10) Patent No.: US 6,634,320 B2
(45) Date of Patent: Oct. 21, 2003

(54) FLAME ATMOSPHERE ANALYZER AND A WATER-HEATING DEVICE INCLUDING THE ANALYZER

(75) Inventors: Maurizio Grando, Ghirignano (IT); Michele Bortoliero, Monselice (IT); Filippo Mingardo, Monselice (IT)

(73) Assignee: Op Controls S.p.A., Pernumia (IT)

( * ) Notice: Subject to any disclaimer, the term of this patent is extended or adjusted under 35 U.S.C. 154(b) by 28 days.

(21) Appl. No.: 10/072,568

(22) Filed: Feb. 8, 2002

(65) Prior Publication Data

US 2002/0106597 A1 Aug. 8, 2002

(30) Foreign Application Priority Data

Feb. 8, 2001 (IT) ..... PD2001A0030

(51) Int. Cl.[7] ..... F23Q 9/08

(52) U.S. Cl. ..... 122/14.2; 122/14.21; 431/278; 431/2

(58) Field of Search ..... 122/14.2, 14.21, 122/14.31; 431/2, 22, 278, 75, 80

(56) References Cited

U.S. PATENT DOCUMENTS 2,488,330 A * 11/1949 Robinson ..... 431/22
4,744,747 A * 5/1988 Kawamura et al. ..... 431/36
5,630,408 A * 5/1997 Versluis ..... 122/14.21
6,162,048 A * 12/2000 Griffioen et al. ..... 431/156

* cited by examiner

*Primary Examiner*—Gregory Wilson
(74) *Attorney, Agent, or Firm*—RatnerPrestia

(57) ABSTRACT

A flame atmosphere analyzer is described and comprises a tube, in which an air-gas intake and mixing chamber is defined, a gas-supply nozzle, and primary combustion-air supply means opening into the intake chamber, as well as a flame burner comprising at least one flame jet which is in flow communication with the intake and mixing chamber in order to supply an air-gas mixture formed in the chamber. The primary air-supply means comprise at least one duct which has a first end in flow communication with the intake chamber and which is open at the opposite, second end in order to take in primary combustion air in a position remote and at a predetermined distance from the intake chamber in the tube. A water-heating device including the above-mentioned flame atmosphere analyzer is also described.

20 Claims, 5 Drawing Sheets

FLAME ATMOSPHERE ANALYZER AND A WATER-HEATING DEVICE INCLUDING THE ANALYZER

DESCRIPTION

Figure 1:
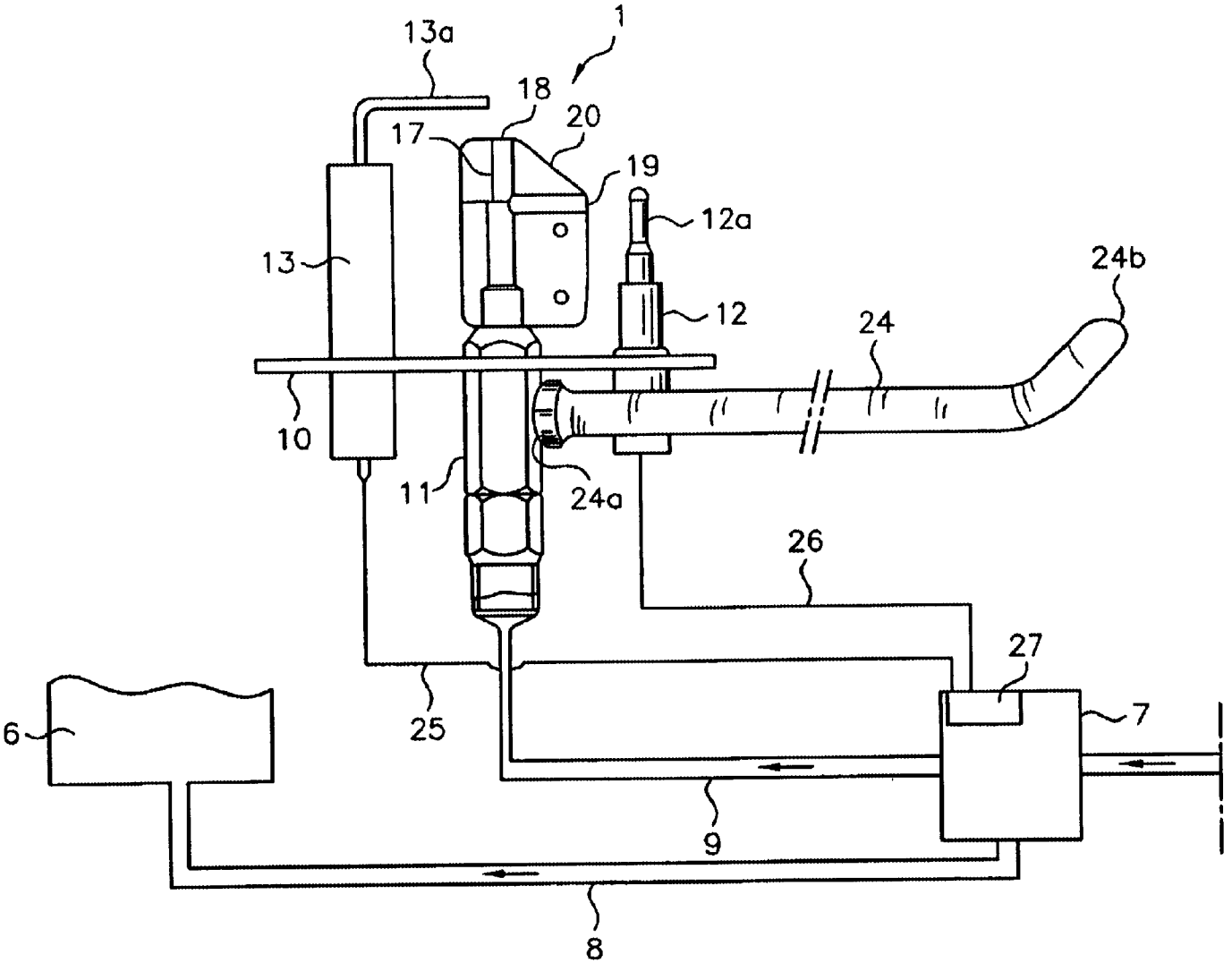

The present invention relates to a flame atmosphere analyzer according to the preamble to the main claim.

The invention also relates to a water-heating device including the analyzer.

The invention concerns, in particular but not exclusively, the field of flame atmosphere analyzers used for piloting the lighting of gas burners provided in storage water heaters for heating water for hygiene purposes.

These analyzers are preferred to other known devices because of the safety functions which typically characterize them. They are in fact used not only for lighting the main burner and for stopping the gas supply to the burner when the flame goes out and/or when the pressure falls below a safety threshold, but also for intervening to cut off the gas supply when the oxygen content of the combustion air falls below a safety value or, conversely, when the carbon-dioxide content rises. To ensure this greater sensitivity, these atmosphere analyzers have dimensions suitable for the use of air-gas mixing ratios such as to give rise to a fairly unstable flame which is susceptible to detachment upon variations in the oxygen content of the air.

In the specific field of storage water heaters for heating water for hygiene purposes, it is known to use these devices in areas such as, for example, garages, which are intended for the parking of motor vehicles and/or for the storage of inflammable materials such as oils, solvents, paints and similar substances. In these cases, liquids or vapours due to leakages of these substances from the storage containers or to leakages of fuel from the motor vehicles may be set on fire by the flame which is present in the burner of the water heater, with dangerous consequences.

To solve this problem at least partially, the prior art has proposed the introduction of special flame-arresting grids in the openings for admitting air to the combustion chambers of water heaters. These grids have very fine mesh configurations which confine the flame within the combustion chamber, preventing it from spreading outside the water heater and consequently being propagated in the surrounding environment.

The main limitation encountered in this proposed solution is due to the fact that dust, hair, and other "dirt" which is normally present in such environments may obstruct these flame-arresting grids, resulting in a worsening of the combustion characteristics, for example, owing to a high level of carbon monoxide (CO) production, and the occurrence of possible functional problems in the water heater, which are connected, for example, with the production of soot, with partial obstruction of the ducts for evacuating discharge fumes, or with possible flare-ups. Naturally, all of this may lead to conditions dangerous to people who are in the vicinity of the environment surrounding the water heater.

The problem underlying the present invention is that of providing a flame atmosphere analyzer, as well as a water-heating device including the analyzer, which have structural and functional characteristics such as to overcome the limitations encountered with reference to the prior art mentioned.

This problem is solved by the invention by means of a flame atmosphere analyzer and a water-heating device including the analyzer which are formed in accordance with the appended claims.

Figure 2:
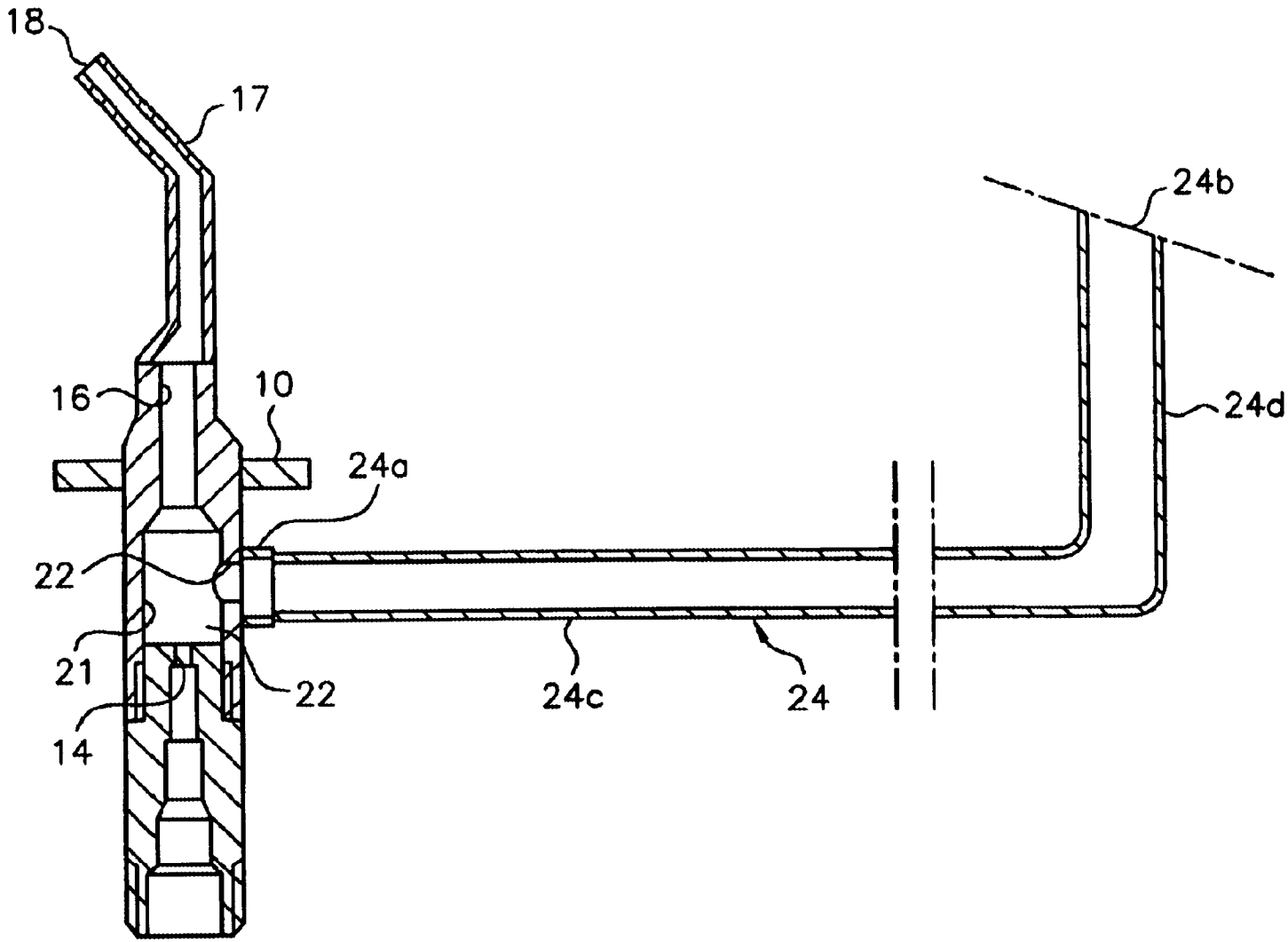
Figure 3:
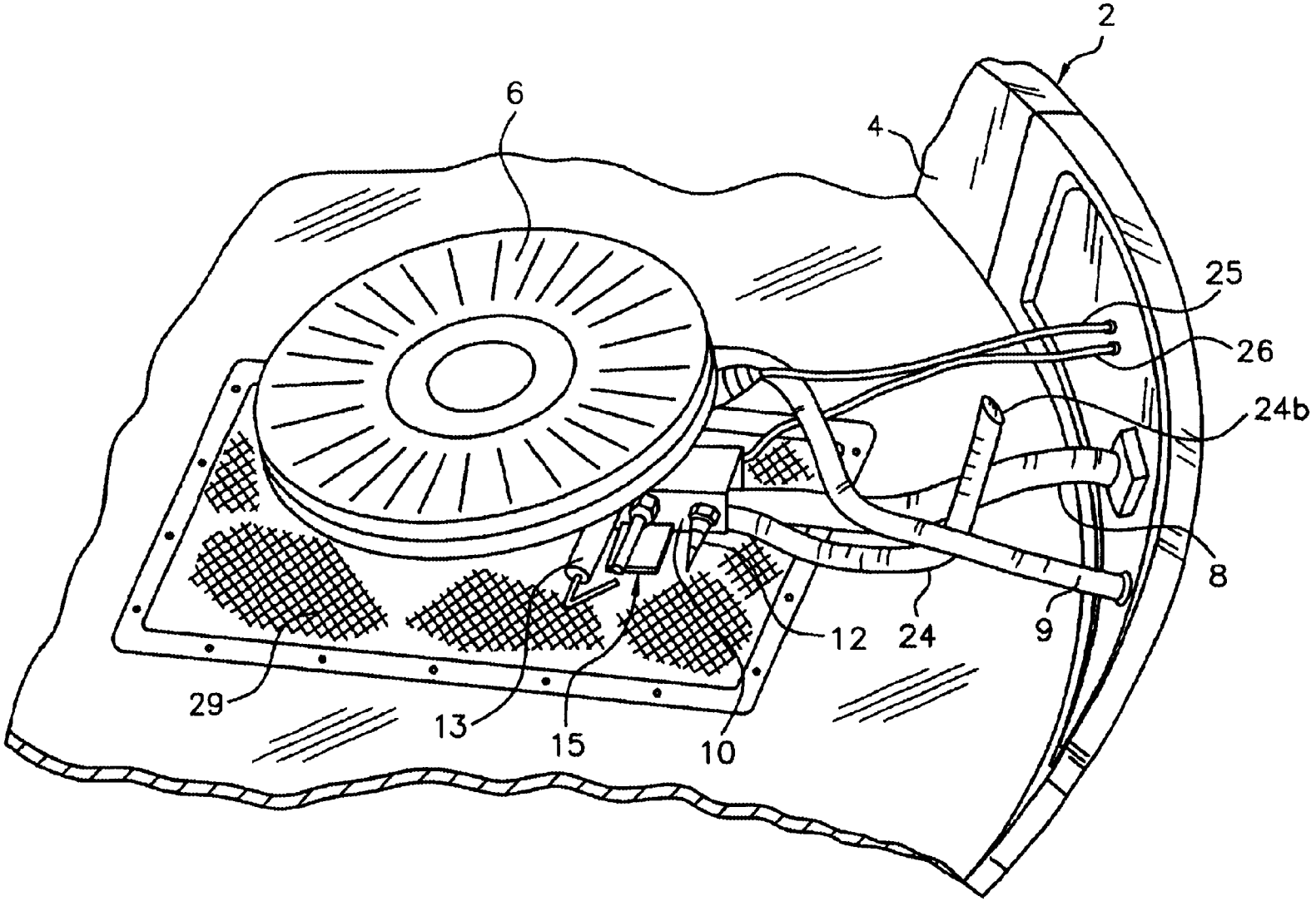
Figure 4:
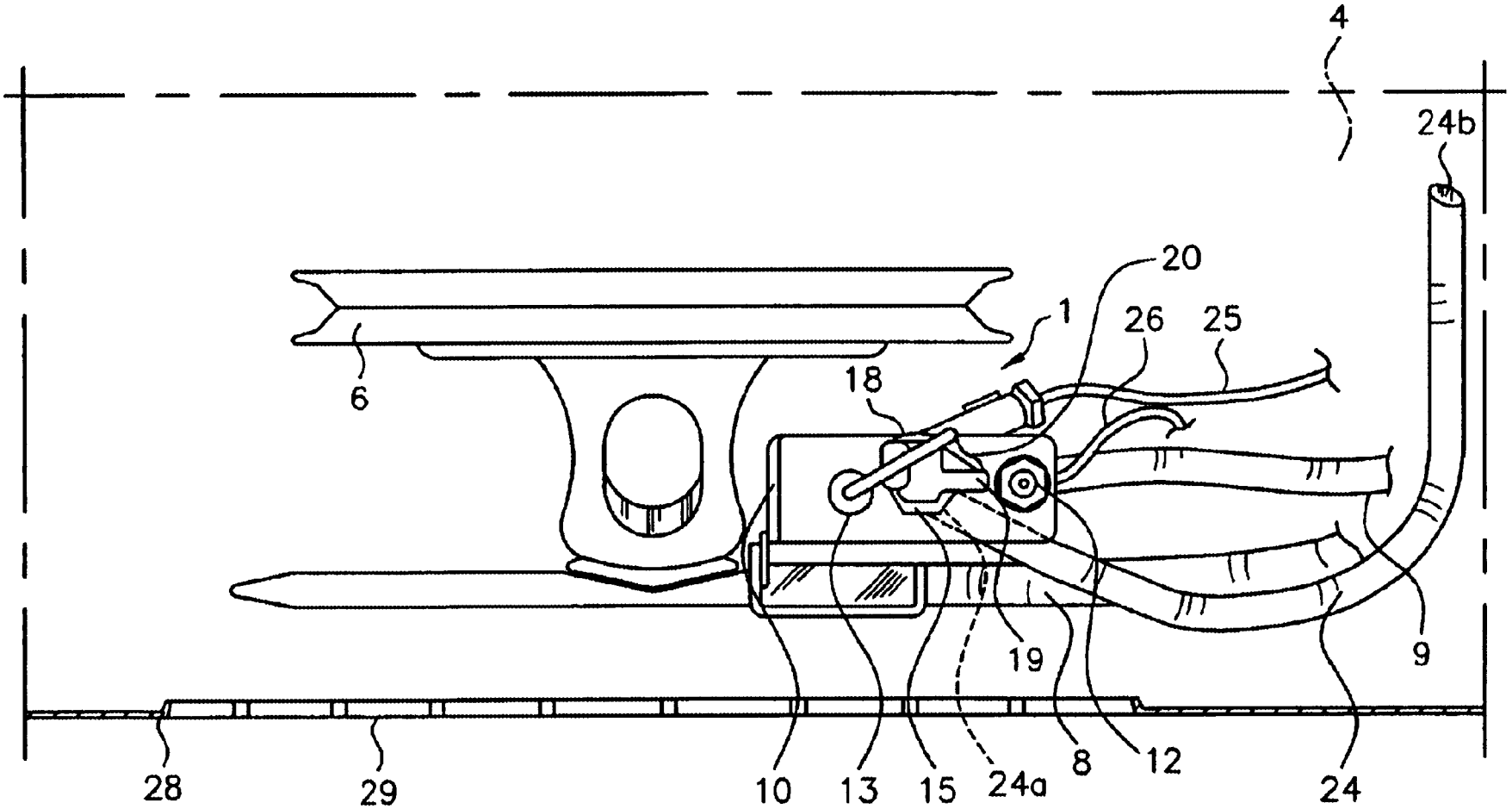
Figure 5:
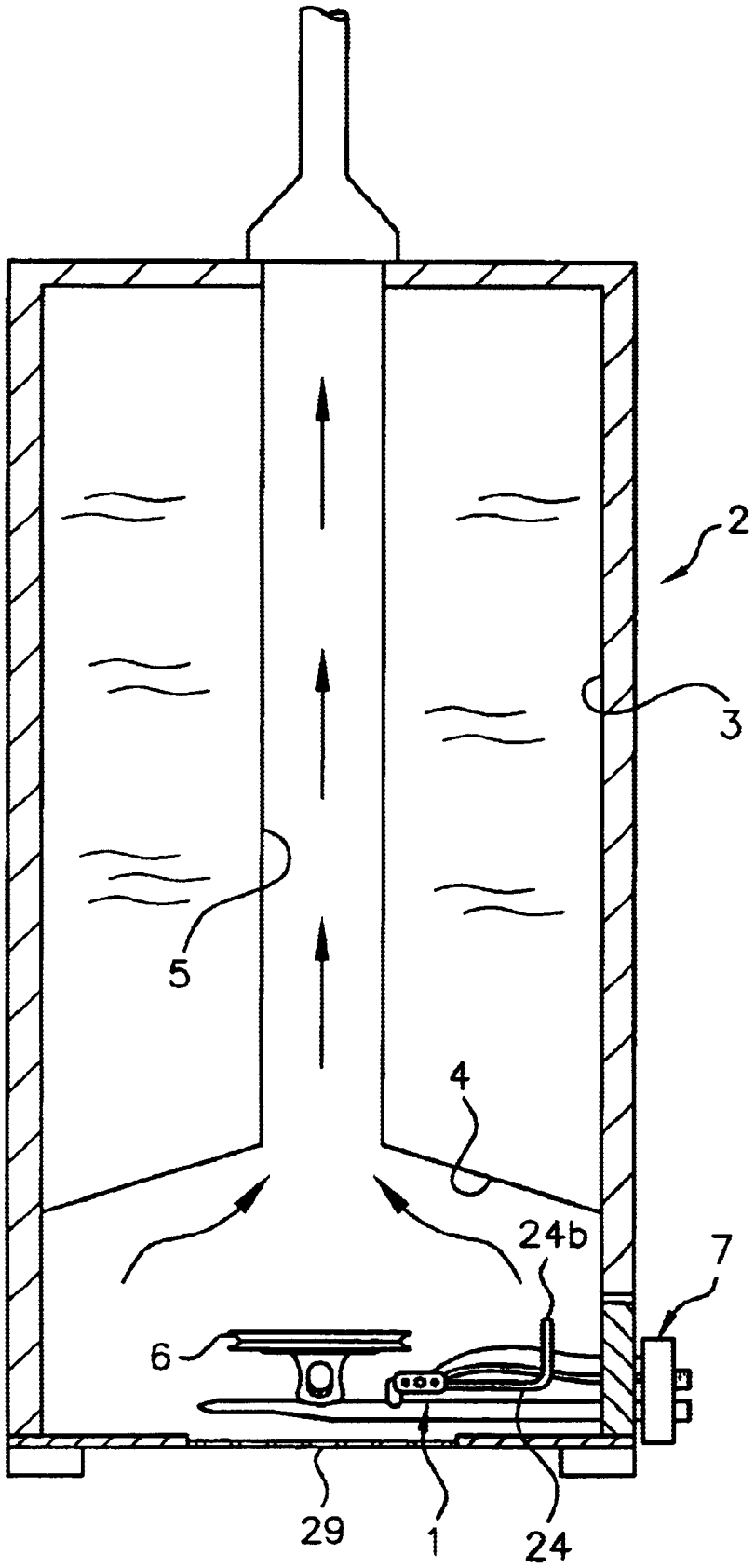

The characteristics and the advantages of the invention will become clearer from the following description of a preferred embodiment thereof, described by way of non-limiting example, with reference to the appended drawings, in which:

FIG. 1 is a schematic front elevational view of a flame atmosphere analyzer formed in accordance with the present invention, FIG. 2 is an axial section through a detail of the analyzer of FIG. 1, FIG. 3 is a partial perspective view of a detail of a water-heating device incorporating the analyzer of the preceding drawings, FIG. 4 is a side elevational view of the detail of FIG. 3, and FIG. 5 is a partial axial section of the water-heating device of FIGS. 3 and 4.

With reference to the drawings mentioned, a flame atmosphere analyzer formed in accordance with the present invention is generally indicated 1 and is designed, in particular but not exclusively, for use in a device for heating water for hygiene purposes, for example, a storage water heater 2, shown schematically in FIG. 5.

The water heater 2 comprises a tank 3, part of which is intended to hold water, and in the bottom of which a combustion chamber 4 is defined, connected to a flue 5 for the discharge of the combustion fumes. A main burner 6 disposed in the chamber 4 is supplied with gas delivered through a valve unit 7 provided in a supply line 8. An auxiliary gas line 9 is also provided for supplying gas to the analyzer 1 through the valve unit 7.

The analyzer 1 comprises a support 10 to which a tube 11, a thermocouple flame-detection device 12, and a flame-igniter plug 13 are fixed.

The tube 11 has a polygonal shape and is hollow internally. A fuel-gas supply nozzle 14 is screwed to one of its ends. A burner 15, fitted on the opposite axial end of the tube, is formed by the coupling of two superimposed plates shaped so as to define a tubular duct 16 and a bent end portion 17 in the region of which the tubular duct 16 branches into a first flame jet and a second flame jet, indicated 18 and 19, respectively. The flame jets 18, 19 diverge substantially at right angles and are connected by a thin flattened duct 20 so as to provide continuity of flame between them.

Ignition of the analyzer 1 is triggered by an electric arc which is established between an electrode 13*a* of the plug 13 and the burner 15 when a potential difference is generated between them, for example, by conventional piezoelectric devices. The electric arc brings about ignition of the air/fuel-gas mixture which emerges through the flame jet 18 and the flame thus ignited is propagated through the flattened duct 20 to the flame jet 19.

The tube 11 comprises an intake and mixing chamber 21 coaxial and in flow communication, at one end, with the tubular duct 16 and, at the other end, with the nozzle 14. The side wall of the tube 11 has a threaded through-hole 22 (or more than one threaded through-hole) which is intended, in accordance with a principal characteristic of the invention, to put the mixing chamber into flow communication with an end 24*a* of a duct 24. The duct 24, which is of tubular shape, is open at its opposite end 24*b* so as to take in primary combustion air for the burner 15 in a position remote and at a predetermined distance from the corresponding inlet hole 22 formed in the side wall of the intake and mixing chamber 21. By virtue of the duct 24, the intake point of the primary combustion air is thus removed from the tube 11 of the analyzer, at a predetermined distance and position the determination of which will become clear from the following description.

The thermocouple flame sensor 12 and the electrode 13*a* of the igniter plug 13 are electrically connected, by means of respective conductors 25, 26, to a driver circuit 27 incorporated in the valve unit 7, and can control a solenoid valve, not shown, for supplying the gas to the main burner 6, with the operative functions described in detail below.

In the combustion chamber 4 of the water heater 2, there are also air-inlet means including an opening 28 covered by a flame-arresting grid 29 having a mesh of a size and closeness such as to ensure that the combustion flame of the burner 6 is contained within the combustion chamber 4, even when inflammable vapours and/or liquids from the external environment surrounding the water heater 2 are set on fire by the flame.

The flame-arresting grid 29 is located below the main burner 6 in a lower portion of the combustion chamber 4, opposite the fume-discharge flue 5. The duct 24 for taking in the primary combustion air preferably opens in this lower portion of the chamber 4, in the vicinity of the main burner 6.

The duct 24 also opens close to the flame-arresting grid 29 and preferably has a first portion 24*c* extending from the intake chamber 21 and a second portion 24*d* forming an extension of the first portion and bent substantially at right angles thereto.

In operation, the duct 24 thus serves to take in and to monitor the primary combustion air in a preselected position in the combustion chamber. When the oxygen content falls below a predetermined minimum value constituting a danger threshold, the amount of oxygen supplied with the primary combustion air is insufficient to keep the flame adhering in a stable manner to the jets 18, 19. In this case, the lack of oxygen is compensated for by the secondary combustion air available at the mouth of the burner 15 and the flame therefore becomes detached from the burner, bringing about cooling of the hot junction of the thermocouple flame sensor 12 and hence stoppage of the fuel-gas supply, for example, by closure of a conventional magnetic unit associated with the solenoid valve of the valve unit 7. This reduced oxygen-content condition may occur if the flame-arresting grid 29 is partially obstructed or blocked, for example, owing to the deposition of dust or other dirt on the mesh of the grid. This causes a worsening of the combustion characteristics, for example, the production of carbon monoxide (CO), which can poison the surrounding environment, with the possibility of flaring-up or the production of soot tending to obstruct the passageway for the discharge of the fumes into the flue. In both situations, tests carried out by the Applicant have shown that monitoring of the primary combustion air in a predetermined position remote from the analyzer tube enables the analyzer to make the system safe by cutting off the gas-flow to the burner before the above-mentioned dangerous conditions resulting from even partial obstruction of the flame-containment grid arise. In particular, the positioning of the intake point of the primary combustion air as indicated in the foregoing description has given improved results in terms of the immediate response of the system when dangerous conditions arise as a result of obstruction of the flame-containment grid, with activation of the magnetic closure unit brought about by the thermocouple which is sensitive to detachment of the flame in the burner.

The water heater is therefore locked out before dangerous conditions due to the obstruction of the flame-arresting grid can arise, by bringing about safety intervention of the analyzer so as to force the user to clean the grid in order to be able to re-light the water heater.

The invention thus solves the problem posed, achieving the advantages indicated above over known solutions.

What is claimed is:

1. A flamed atmosphere analyzer comprising:

a tube defining an air-gas intake and mixing chamber;

a gas-supply nozzle opening into the air-gas intake and mixing chamber;

a flame burner comprising at least one flame jet which is in flow communication with the air-gas intake and mixing chamber in order to supply an air-gas mixture formed in the air-gas intake and mixing chamber to the burner; and a primary combustion air-supply means comprising at least one duct which has a first end in flow communication with the air-gas intake and mixing chamber and which is open at the opposite, second end in order to take in the primary combustion air in a position remote and at a predetermined distance from the air-gas intake and mixing chamber in the tube.

2. The analyzer according to claim 1 in which the duct is tubular.

3. The analyzer according to claim 2 further comprising a flame-detection means connected to a circuit for controlling the supply of gas to the gas-supply nozzle in order to interrupt the gas-flow to the gas-supply nozzle when the level of oxygen in the primary combustion air taken from the duct falls below a predetermined value bringing about detachment of the flame from the burner and consequent intervention of the flame-detection means.

4. The analyzer according to claim 3 in which the flame-detection means comprises a thermocouple flame sensor.

5. The analyzer according to claim 4 in which the burner comprises at least two flame jets which diverge from one another and the side walls of which are substantially closed to the exterior except for an optional connecting duct between the flame jets for the lighting of one by the other, the thermocouple flame sensor being positioned relative to the jets in a manner such as to be struck by the flame of only one of them.

6. The analyzer according to claim 1 further comprising a flame-detection means connected to a circuit for controlling the supply of gas to the gas-supply nozzle in order to interrupt the gas-flow to the gas-supply nozzle when the level of oxygen in the primary combustion air taken from the duct falls below a predetermined value bringing about detachment of the flame from the burner and consequent intervention of the flame-detection means.

7. The analyzer according to claim 6 in which the flame-detection means comprises a thermocouple flame sensor.

8. The analyzer according to claim 7 in which the burner comprises at least two flame jets which diverge from one another and the side walls of which are substantially closed to the exterior except for an optional connecting duct between the flame jets for the lighting of one by the other, the thermocouple flame sensor being positioned relative to the jets in a manner such as to be struck by the flame of only one of them.

9. A water-heating device comprising:

a flame atmosphere analyzer including:

(a) a tube defining an air-gas intake and mixing chamber, (b) a gas-supply nozzle opening into the air-gas intake and mixing chamber, (c) a flame burner comprising at least one flame jet which is in flow communication with the air-gas intake and mixing chamber in order to supply an air-gas mixture formed in the air-gas intake and mixing chamber to the burner, and (d) a primary combustion air-supply means comprising at least one duct which has a first end in flow communication with the air-gas intake and mixing chamber and which is open at the opposite, second end in order to take in the primary combustion air in a position remote and at a predetermined distance from the air-gas intake and mixing chamber in the tube;

a combustion chamber;

a main burner disposed in the combustion chamber and piloted by the analyzer; and means for admitting air to the combustion chamber, including partition means for the air admitted to the combustion chamber, the duct extending into the combustion chamber from the tube of the analyzer so as to take in the primary combustion air in the vicinity of the main burner.

10. The device according to claim 9 further comprising means for discharging the combustion fumes from a first portion of the combustion chamber and in which the partition means comprises at least one flame-arresting grid for containing the flame within the combustion chamber, the at least one grid being arranged in a second portion of the combustion chamber opposite the discharge means, and the duct for taking in primary combustion air opening in the second portion of the combustion chamber.

11. The device according to claim 10 in which the duct opens in the combustion chamber in the vicinity of the flame-arresting grid in order to detect any changes in the oxygen level of the primary combustion air as a result of at least partial obstruction of the flame-arresting grid.

12. The device according to claim 11 in which the duct comprises a first portion extending from the air-gas intake and mixing chamber in the tube and a second portion forming an extension of the first portion with a predetermined inclination to the first portion and opening at the opposite, free end of the duct.

13. The device according to claim 12 further comprising a tank for the storage and heating of water for hygiene purposes.

14. The device according to claim 11, further comprising a tank for the storage and heating of water for hygiene purposes.

15. The device according to claim 10, in which the duct comprises a first portion extending from the air-gas intake and mixing chamber in the tube and a second portion forming an extension of the first portion with a predetermined inclination to the first portion and opening at the opposite, free end of the duct.

16. The device according to claim 10, further comprising a tank for the storage and heating of water for hygiene purposes.

17. The device according to claim 9, in which the duct comprises a first portion extending from the air-gas intake and mixing chamber in the tube and a second portion forming an extension of the first portion with a predetermined inclination to the first portion and opening at the opposite, free end of the duct.

18. The device according to claim 17, further comprising a tank for the storage and heating of water for hygiene purposes.

19. The device according to claim 9, further comprising a tank for the storage and heating of water for hygiene purposes.

20. A flame atmosphere analyzer comprising:

a tube defining an air-gas intake and mixing chamber;

a gas-supply nozzle opening into the air-gas intake and mixing chamber;

a flame burner comprising a first flame jet which is in flow communication with the air-gas intake and mixing chamber in order to supply an air-gas mixture formed in the air-gas intake and mixing chamber to the burner and a second flame jet, the two flame jets diverging from one another and the side walls of which are substantially closed to the exterior except for an optional connecting duct between the flame jets for the lighting of one by the other;

a primary combustion air-supply means comprising at least one tubular duct which has a first end in flow communication with the air-gas intake and mixing chamber and which is open at the opposite, second end in order to take in the primary combustion air in a position remote and at a predetermined distance from the air-gas intake and mixing chamber in the tube; and a thermocouple flame sensor connected to a circuit for controlling the supply of gas to the gas-supply nozzle in order to interrupt the gas-flow to the gas-supply nozzle when the level of oxygen in the primary combustion air taken from the duct falls below a predetermined value bringing about detachment of the flame from the burner and consequent intervention of the thermocouple flame sensor, the thermocouple flame sensor being positioned relative to the jets in a manner such as to be struck by the flame of only one of them.

* * * * *